US008430276B2

(12) United States Patent
Longo, II

(10) Patent No.: US 8,430,276 B2
(45) Date of Patent: Apr. 30, 2013

(54) CARTRIDGE FOR CAULKING COMPOUND, SEALANT AND/OR ADHESIVES

(75) Inventor: William J. Longo, II, Mentor, OH (US)

(73) Assignee: Henkel Corporation, Rocky Hill, CT (US)

( * ) Notice: Subject to any disclaimer, the term of this patent is extended or adjusted under 35 U.S.C. 154(b) by 1257 days.

(21) Appl. No.: 11/328,537

(22) Filed: Jan. 10, 2006

(65) Prior Publication Data

US 2007/0158370 A1 Jul. 12, 2007

(51) Int. Cl.
*B65D 88/54* (2006.01)
*B67D 1/00* (2006.01)

(52) U.S. Cl.
USPC ..... 222/327; 222/80; 222/386; 222/1; 285/305

(58) Field of Classification Search ..... 222/327, 222/326, 391, 386, 1, 80; 220/315; 285/305
See application file for complete search history.

(56) References Cited

U.S. PATENT DOCUMENTS 2,996,223 A * 8/1961 Dolezal et al. ..... 222/327
4,077,550 A * 3/1978 van Manen ..... 222/327
5,046,877 A 9/1991 Longo
5,301,839 A 4/1994 Eierle et al.
5,626,265 A * 5/1997 Woodruff ..... 222/327
6,976,608 B2 12/2005 Ichikawa et al.
7,014,070 B1 * 3/2006 Stefely et al. ..... 222/327

FOREIGN PATENT DOCUMENTS

KR 20-0194281 9/2000

OTHER PUBLICATIONS

International Search Report dated May 25, 2007 for PCT/US2007/060260.
Translation of selected portions of Korean Publication No. 20-0194281Y1 dated Jun. 27, 2007.

* cited by examiner

*Primary Examiner* — Kevin P Shaver
*Assistant Examiner* — Melvin Cartagena
(74) *Attorney, Agent, or Firm* — Fay Sharpe LLP

(57) ABSTRACT

A cartridge for a flowable material, e.g. caulking compounds, sealants and adhesives, includes a tubular container, an end plate disposed at a first end to a tubular container, a nozzle extending from the end plate, a plunger received in the tubular container, and a barb extending inwardly from the tubular container. The end plate includes an opening. The nozzle is in communication with the opening. The barb is configured to limit movement of the plunger in a first axial direction. A method for packaging a flowable material includes introducing flowable material into a tubular container, inserting a plunger into the container, and deforming the tubular container at a location axially spaced from an end of the container at a location axially spaced from an end of the container to create a mechanical stop.

2 Claims, 3 Drawing Sheets

CARTRIDGE FOR CAULKING COMPOUND, SEALANT AND/OR ADHESIVES

BACKGROUND

A dispensing cartridge for caulking compounds, sealants, adhesives and other similar coating materials typically includes a hollow elongated tubular container for confining the material and a tapered nozzle serving as a port for dispensing material from the container. The nozzle is fixed to an end cap that is attached to one end of the container. A plunger is positioned at an opposite end of the container with the material disposed between the end cap and the plunger. To dispense material from the cartridge, the tip of the nozzle typically is cut off at an angle and pressure is applied to the plunger using a conventional caulking gun, or similar mechanism, causing the material to flow out of the nozzle to the adjacent surfaces to be caulked or sealed.

In manufacturing, the cartridge is filled with material once the top end cap is affixed at one end of the container. Next, the plunger and a ring seal are inserted into the container. The ring seal abuts an inner circumferential surface of a skirt of the plunger, the skirt being an axially extending annular portion of the plunger. The ring seal extends axially beyond a second end of the tubular container, the second end being opposite the end where the nozzle and end cap are attached. The ring seal is deformed, e.g. crimped, around the second end of the container to retain the plunger. Upon completion of the manufacturing process the ring seal prevents movement of the plunger in an axial direction away from the first end while allowing the plunger to move towards the top end cap when pressure is applied to the plunger.

Attaching the ring seal to the tubular container requires a complex process that involves rotating the tubular container. This rotation results in a vortex being formed in the material already in the container which results in an air gap in the container after the plunger is installed. This air gap is undesirable because the entrained air causes material to continue to flow out of the cartridge after the user of the caulking gun has tried to stop the flow of material. Also, since the ring seal attaches around the lower end of the tubular container, if the cartridge is dropped, then the second end, i.e. the end with the ring seal, deforms along with the ring seal. This deformation of the second end of the container inhibits the insertion of the push rod of the conventional caulking gun. Furthermore, readjustment of the ring seal to allow insertion of the push rod of the caulking gun is quite difficult.

As opposed to using a ring seal to limit axial movement of the plunger away from the top end of the tubular container, another method for retaining the plunger includes rolling the lower edge of the tubular container over thus decreasing the diameter of the lower end of the tubular container. This smaller diameter portion limits axial movement of the plunger away from the upper end while allowing movement of the plunger towards the upper end of the container. By only rolling over the lower edge of the container; however, the plunger is not sufficiently pushed towards the upper end of the tubular container to protect it from damage that may occur if the cartridge is dropped. Furthermore, simply rolling over the lower edge of the tubular container does not provide a very secure arrangement for containing the plunger. Additionally, by only rolling over the lower edge of the container, achieving a coplanar edge on which the plunger can rest is difficult.

SUMMARY OF THE INVENTION

Accordingly, it is desirable to provide a cartridge for a material that overcomes the aforementioned problems. One example of such a cartridge includes a tubular container, an end plate disposed at a first end to a tubular container, a nozzle extending from to the end plate, a plunger received in the tubular container, and a barb extending inwardly from the tubular container. The end plate includes an opening. The nozzle is in communication with the opening. The barb is configured to limit movement of the plunger in a first axial direction.

Furthermore, it is desirable to provide a method for packaging a flowable material that overcomes the difficulties discussed above. Such a method includes introducing flowable material into a tubular container, inserting a plunger into the container, and deforming the tubular container at a location axially spaced from an end of the container to create a mechanical stop for the plunger. An end plate and a nozzle attach to a first end to the tubular container. The mechanical stop limits the movement of the plunger in a first axial direction.

According to yet another embodiment, a cartridge of material includes a tubular container, a flowable material disposed in the tubular container, an end plate affixed to the a first end of the tubular container, a nozzle affixed to the end plate, a plunger disposed in the container, and a mechanical stop formed in the tubular container. The end plate includes an opening such that the flowable material can pass through the opening. The nozzle is in communication with the opening. The mechanical stop is formed between a second end and the plunger in the tubular container.

BRIEF DESCRIPTION OF THE DRAWINGS

FIG. 1 is a perspective view of a cartridge containing a caulking compound, a sealant, an adhesive, or the like.

DETAILED DESCRIPTION

Figure 1:
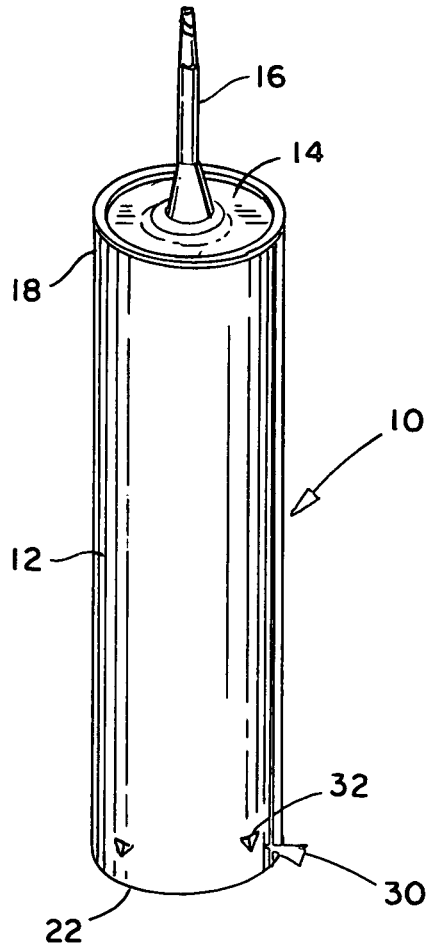

With reference to FIG. 1, a cartridge 10 generally includes a-tubular container 12, an end plate 14, and a nozzle 16. The depicted cartridge is used to store and is a package for a flowable material, such as a caulking compound, an adhesive, a sealant, or a similar material (simply referred to as "material" hereafter for the sake of brevity). Typically the material is a viscous, plastic flowable substance that is expelled from the cartridge 10 through the nozzle 16 in a manner that will be described in more detail below.

The tubular container 12 in the depicted embodiment has a circular configuration in a cross-section taken normal to a longitudinal axis of the container. Nevertheless, the tubular container is not limited to only circular configurations. For the ease of understanding the depicted embodiments and not to limit the invention to any particular configuration other than that which is claimed, the cartridge will be described as including an axial dimension that runs parallel to the longitudinal axis of the cartridge and a radial dimension that emanates from the longitudinal axis and is perpendicular thereto. The tubular container can be made of cardboard, plastic, or similar durable material. The diameter (or area of base) and the height of the tubular container is a function of the amount of flowable material that is to be stored in the cartridge 10.

The end plate 14 attaches to and/or is disposed at a first end 18 of the tubular container 12. For ease of understanding the drawings only, the first end 18 will be referred to as the upper end; however, such a term should not be deemed as limiting, especially since when in use the first end 18 is typically lower than a second end 22 when the cartridge 10 is loaded into a conventional caulking gun and material is being expelled or dispensed from the nozzle 16. The end plate 14 is affixed to the first end 18 and can be made from any suitable conventional material, such as metal. Alternatively, the end plate 14 can be formed integrally, e.g. molded as a single piece, with the tubular container 12. Accordingly, the end plate 14 can also be made of plastic, or other similar material. The end plate 14 includes a central opening (not visible). The nozzle 16 extends axially from the end plate 14 and at least substantially surrounds the opening in the end plate such that material that is stored in the tubular container can exit the cartridge 10 via the nozzle 16. The nozzle 16 can be cut with a knife or scissors to form an opening through which the material flows, and therefore can be made of a plastic material. The tubular container 12, the end plate 14, and the nozzle 16 are similar to those that are known in the art.

The cartridge 10 can be loaded into a conventional caulking gun, similar to a known cartridge. A push rod of the caulking gun contacts a plunger 24 (FIG. 2) moving the plunger 24 axially towards the nozzle 16 to dispense material through the nozzle. The plunger 24 is similar to the plungers used in conventional cartridges in that the plunger is circular and includes an annular skirt 26 that abuts an inner edge of the tubular container 12. The plunger 24 can be made of metal or plastic and has a complementary shape, which in this embodiment is circular, to the tubular container 12 that receives the plunger.

A mechanical stop 30 is provided to limit axial movement of the plunger 24 away from the upper end 18 of the tubular container 12. The mechanical stop 30 inhibits the plunger 24 from backing out of the tubular container 12, for instance when the material stored in the cartridge expands, for example when there is an increase in temperature.

In the depicted embodiment, three mechanical stops 30 are provided 120 degrees apart from one another around the circumference adjacent the lower end 22 of the tubular container 12. Where three mechanical stops 30 are provided these stops define a plane (three points defining a plane) in which the retained plunger 24 can reside. Nevertheless, a fewer or greater number of mechanical stops 30 can be provided.

Figure 2:
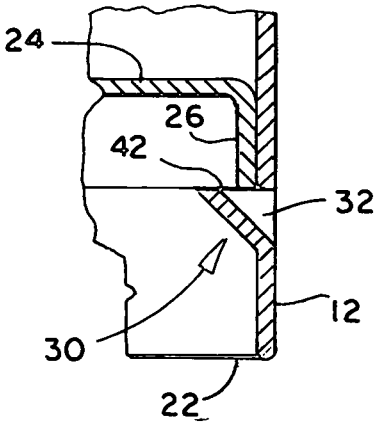
FIG. 2 is a side cross-sectional view of a lower portion of the cartridge of FIG. 1 showing a portion of a plunger disposed in the cartridge.
Figure 3:
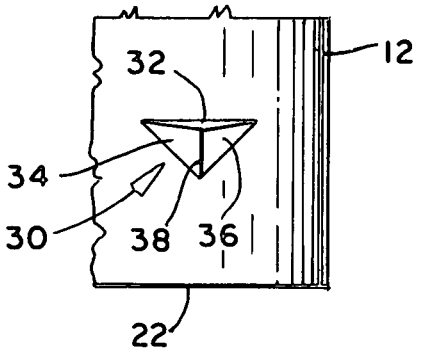
FIG. 3 is an elevation view, similar to FIG. 2, of the lower portion of the cartridge of FIG. 1 without showing the plunger.

As more clearly seen in FIGS. 2 and 3, each mechanical stop 30 is axially spaced from the lower end 22 of the tubular container 12. More specifically, the lowest portion of each mechanical stop 30 is spaced a predetermined distance, e.g. ¾-1 inches, from the lower end 22 of the container 12. By axially spacing the mechanical stops 30 from the lower end 22, deformation of the lower end 22 of the tubular container 12, for example where the cartridge 10 is dropped, should not damage the mechanical stop 30 in a manner that might result in a plunger 24 backing out of the tubular container 12. Also, the lower end 22 can be easily bent back into a generally circular configuration so that the push rod of a conventional caulk gun can be received in the lower end 22.

In the embodiment depicted in FIGS. 1-3, the mechanical stop 30 is formed using a device, which will be described in more detail below, that strikes the tubular container 12 just below the skirt 26 of the plunger 24. It should be apparent from the figures, where the cartridge 12 is filled with the first end 18 as a lower end, the mechanical stop 30 is formed above the skirt 26 of the plunger 24. Formation of the mechanical stop 30 results in an opening 32 being formed in the tubular container 12 adjacent the lower end 22 of the tubular container. In the depicted embodiment, the opening 32 is triangular in configuration and the mechanical stop 30 has a configuration similar to a burr that includes a first planar wall 34 and a second planar wall 36 that each include a common linear edge 38. Accordingly, as more clearly seen in FIG. 2, a shelf 42 is provided upon which the plunger 24 can rest. The shelf 42 extends radially inwardly from an inner surface of the container 12. Where three or more mechanical stops 30 are provided, the shelves 42 can define a common plane.

Figure 4:
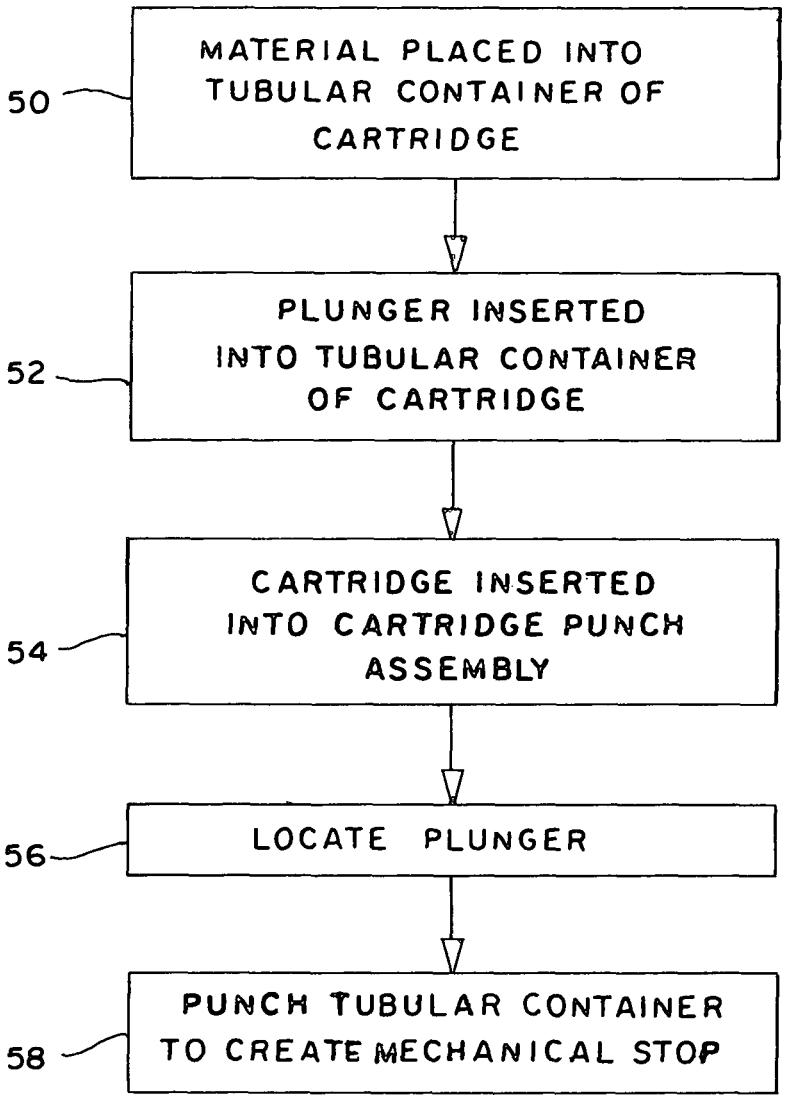
FIG. 4 is a schematic diagram depicting a method of packaging a material in a cartridge, such as the cartridge depicted in FIG. 1.

With reference to FIG. 4, the method of packaging a flowable material in the cartridge 10 will be more particularly described. At step 50, material, e.g. caulking compound, adhesive, sealant or the like, is placed into the tubular container 12(FIG. 1) of the cartridge 10 after the end plate 14 and the nozzle 16 has been affixed to the tubular container. At step 52, the plunger 24 (FIG. 2) is inserted into the tubular container 12 of the cartridge 10. Steps 50 and 52 are similar to a known method for placing a material in a cartridge. As opposed to placing a ring seal inside a tubular container, which is done in a known method, only the plunger 24 need be inserted into the tubular container. At step 54, the cartridge 10 is inserted into a cartridge punch assembly, which will be described in more detail below. At step 56, while loaded in the cartridge punch assembly the plunger 24 is located in the tubular container 12 and at step 58 the tubular container is punched, or deformed in another manner, to create a mechanical stop 30 to retain the plunger 24 from backing out of the tubular container 12. Such a method does not require rotation of the cartridge 10 and/or tubular container 12, thus the air void that was formed using the known method having a ring seal is eliminated or greatly reduced.

Figure 6:
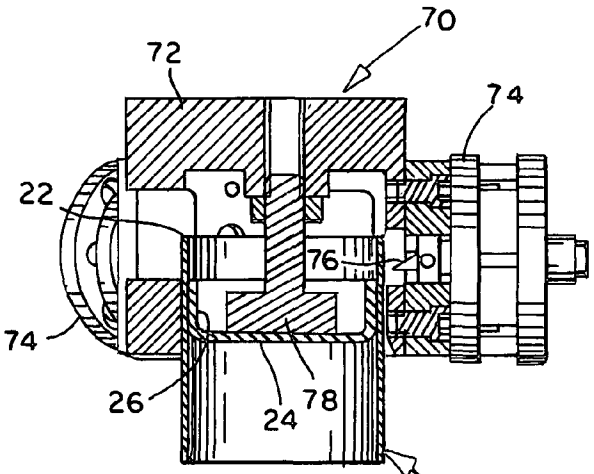
FIG. 6 is a cross-sectional view of the cartridge punch assembly depicted in FIG. 5 taken along line 6-6.
Figure 5:
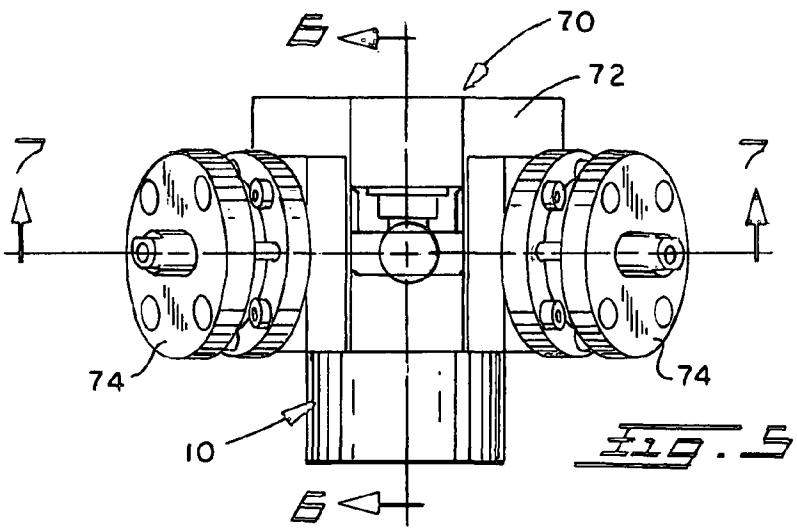
FIG. 5 is an elevation view of a cartridge punch assembly for use in the manufacturing process of filling the cartridge depicted in FIG. 1.
Figure 7:
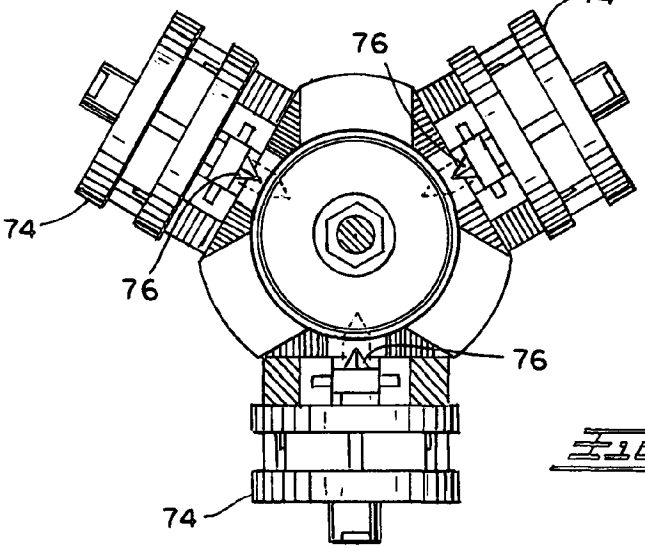
FIG. 7 is a cross-sectional view of FIG. 5 taken along lines 7-7.

As described above, the cartridge 10 (FIG. 1) is inserted into a cartridge punch assembly 70 that includes a cartridge alignment head 72, a plurality of punch actuating devices 74, a plurality of punch tools 76, and an adjustable depth stop 78. As seen in FIGS. 5 and 6, the cartridge 10 is inserted into the cartridge punch assembly 70 in a manner that the adjustable depth stop 78 presses against the plunger 24 retaining the plunger at a desired location with respect to the second end 22 of the tubular container 12. The adjustable depth stop 78 can be adjusted from a base surface against which the second end 22 of the tubular container 12 rests to locate the plunger 24 in a desired location. The punch actuating devices 74, which in the depicted embodiment are pneumatic cylinders, actuate the punch tools 76 (three are depicted 120 degrees apart) to strike the cartridge 10 just above (as depicted in FIG. 6) the plunger skirt 26 to form the mechanical stops 30 (FIG. 1). Each punching tool 76 has a general pyramid shaped configuration that includes a point to facilitate a clean punch through the tubular container 12 of the cartridge 10. The pyramid shaped punching tool 76 forms a shelf 42 (FIG. 2) having a substantially triangular configuration when viewed in a cross-section taken normal to the longitudinal axis of the cartridge 10. Alternatively, the punching tool 76 can take an alternative configuration, which would result in an alternative configuration for the mechanical stop 30. For example, the punching tool 76 can have a rounded configuration resulting in a mechanical stop having a rounded shelf edge.

The above-described cartridge provides a robust package for caulking compounds, adhesives, sealants and the like, that can be inexpensively manufactured and that overcomes the aforementioned difficulties discussed above. The depicted cartridge 10 is not as prone to unfixable damage as known cartridges that include ring seals or rolled over ends to retain a plunger in a tubular container. Also when three mechanical stops are provided, the plunger that is retained inside the cartridge resides in a plane that is defined by only three points or general locations as opposed to a continuous ring seal or rolled edge that may deviate from a single plane.

Various of the above disclosed and other features and functions, or alternatives thereof, may be desirably combined into many other different systems or applications. Also various presently unforeseen or unanticipated alternatives, modifications, variations or improvements therein may be subsequently made by those skilled in the art which are also intended to be encompassed by the following claims.

The invention claimed is:

1. A cartridge for a material comprising:

a tubular container having a diameter and a circumference;

a flowable material disposed in the tubular container;

an end plate disposed at a first end of the tubular container, the end plate having an opening such that the flowable material can pass through the opening;

a nozzle extending from the end plate, the nozzle being in communication with the openning;

a plunger disposed in the container;

a plurality of mechanical stops formed in the tubular container between a second end of the tubular container and the plunger, the mechanical stops being spaced around the circumference of the tubular container so that a first and a second of the plurality of mechanical stops are located on a first side of the diameter and a third of the plurality of mechanical stops is located on a second side of the diameter, the mechanical stops also being axially spaced from a second end of the tubular container wherein each mechanical stop comprises a barb that is punched out of the tubular container and each mechanical stop includes first and second planar walls that share a common edge.

2. A method of packaging a flowable material in a cartridge the method comprising:

introducing flowable material into a tubular container of a cartridge having an end plate and a nozzle at a first end of the tubular container;

inserting a plunger into the tubular container;

after inserting the plunger, deforming the tubular container near a second end of the tubular container to create a mechanical stop movement of the plunger in a first axial direction, wherein at least two of the mechanical stops are located on a first side of a diameter of the tubular container and a third of the mechanical stops is located on a second side of the diameter;

the deforming the tubular container includes punching the tubular container with a punch tool to form a shelf having first and second planar walls that share a common edge.

* * * * *